US007874763B2

(12) United States Patent
Benedetti

(10) Patent No.: US 7,874,763 B2
(45) Date of Patent: Jan. 25, 2011

(54) BURNER FOR PAVING APPARATUS

(75) Inventor: Angelo Benedetti, Brecksville, OH (US)

(73) Assignee: Asphalt Recycling System, Brecksville, OH (US)

( * ) Notice: Subject to any disclaimer, the term of this patent is extended or adjusted under 35 U.S.C. 154(b) by 267 days.

(21) Appl. No.: 12/259,710

(22) Filed: Oct. 28, 2008

(65) Prior Publication Data

US 2010/0104364 A1 Apr. 29, 2010

(51) Int. Cl.
*E01C 7/06* (2006.01)

(52) U.S. Cl. ..... 404/95; 404/77; 404/79

(58) Field of Classification Search ..... 404/77, 404/79, 95

See application file for complete search history.

(56) References Cited

U.S. PATENT DOCUMENTS 2,274,517 A * 2/1942 Ashmore ..... 264/31
3,132,642 A * 5/1964 Fingland ..... 126/271.2 R
3,311,104 A * 3/1967 Wollner et al. ..... 126/92 R
3,807,886 A * 4/1974 Cutler ..... 404/77
4,534,674 A * 8/1985 Cutler ..... 404/75
6,939,179 B1 * 9/2005 Kieffer et al. ..... 439/650

* cited by examiner

*Primary Examiner*—Raymond W Addie
(74) *Attorney, Agent, or Firm*—Tarolli, Sundheim, Covell & Tummino LLP

(57) ABSTRACT

A heating head for a paving apparatus includes a substantially cylindrical head housing, having a top housing edge axially spaced from a bottom housing edge, a sidewall having a spiral cross-sectional shape and a laterally extending top housing cover attached to at least a portion of the top housing edge. The head housing defines an air chamber and is adapted to accept and direct airflow through the heating head. The sidewall defines an intake vent at a radially outward end and an air chamber inlet at a radially inward end. The intake vent and air chamber inlet are spaced apart and in mutual fluid communication via an elongated circumferentially extending air passage to direct airflow from an exterior of the heating head to the air chamber.

22 Claims, 5 Drawing Sheets

BURNER FOR PAVING APPARATUS

TECHNICAL FIELD

The present invention relates to a burner for use in a paving apparatus.

BACKGROUND OF THE INVENTION

When a roadway, parking lot, or other paved area becomes sufficiently worn from use, weather, or other causes, it is often desirable to resurface or repave the paved area. In conventional resurfacing processes, pavement is mechanically removed from the paved area, by a scarifier or a rotary milling machine. The pavement may be preheated to facilitate such removal. The loose pavement produced by such a process may be recycled. The loose pavement is treated to renew the material properties of the asphalt already present within the loose pavement. The recycled loose pavement may be laid back down on the substrate or transported away for use in another paved area.

SUMMARY OF THE INVENTION

According to an embodiment of the present invention, a heating head for a paving apparatus is described. The heating head includes a substantially cylindrical head housing, having a top housing edge axially spaced from a bottom housing edge, a sidewall having a spiral cross-sectional shape and a laterally extending top housing cover attached to at least a portion of the top housing edge. The head housing defines an air chamber and is adapted to accept and direct airflow through the heating head. The sidewall defines an intake vent at a radially outward end and an air chamber inlet at a radially inward end. The intake vent and air chamber inlet are spaced apart and in mutual fluid communication via an elongated circumferentially extending air passage to direct airflow from an exterior of the heating head to the air chamber.

According to an embodiment of the present invention, a heating system for a paving apparatus having a furnace body and a suspension system supporting the furnace body and heating system for movement along a paved area is provided. A heating frame is carried by the suspension system and is adapted to movably hold a plurality of heating heads a predetermined distance from the paved area. A fan is located within the furnace body and is adapted to circulate air through the furnace body. An air box is associated with the heating frame and is adapted to absorb heat from the heating frame and disperse the heat to airflow within the furnace body and to airflow directed to an air intake of at least one heating head. The air intake of the heating head includes an elongated circumferentially extending air passage wrapping around at least a portion of the heating head. The air passage has an intake vent at a radially outward end and an air chamber inlet at a radially inward end. The intake vent and air chamber inlet are spaced apart and in mutual fluid communication via the air passage to direct airflow from an exterior of the heating head to an air chamber within the heating head.

BRIEF DESCRIPTION OF THE DRAWINGS

For a better understanding of the invention, reference may be made to the accompanying drawings, in which.

DESCRIPTION OF EMBODIMENTS

Figure 1:
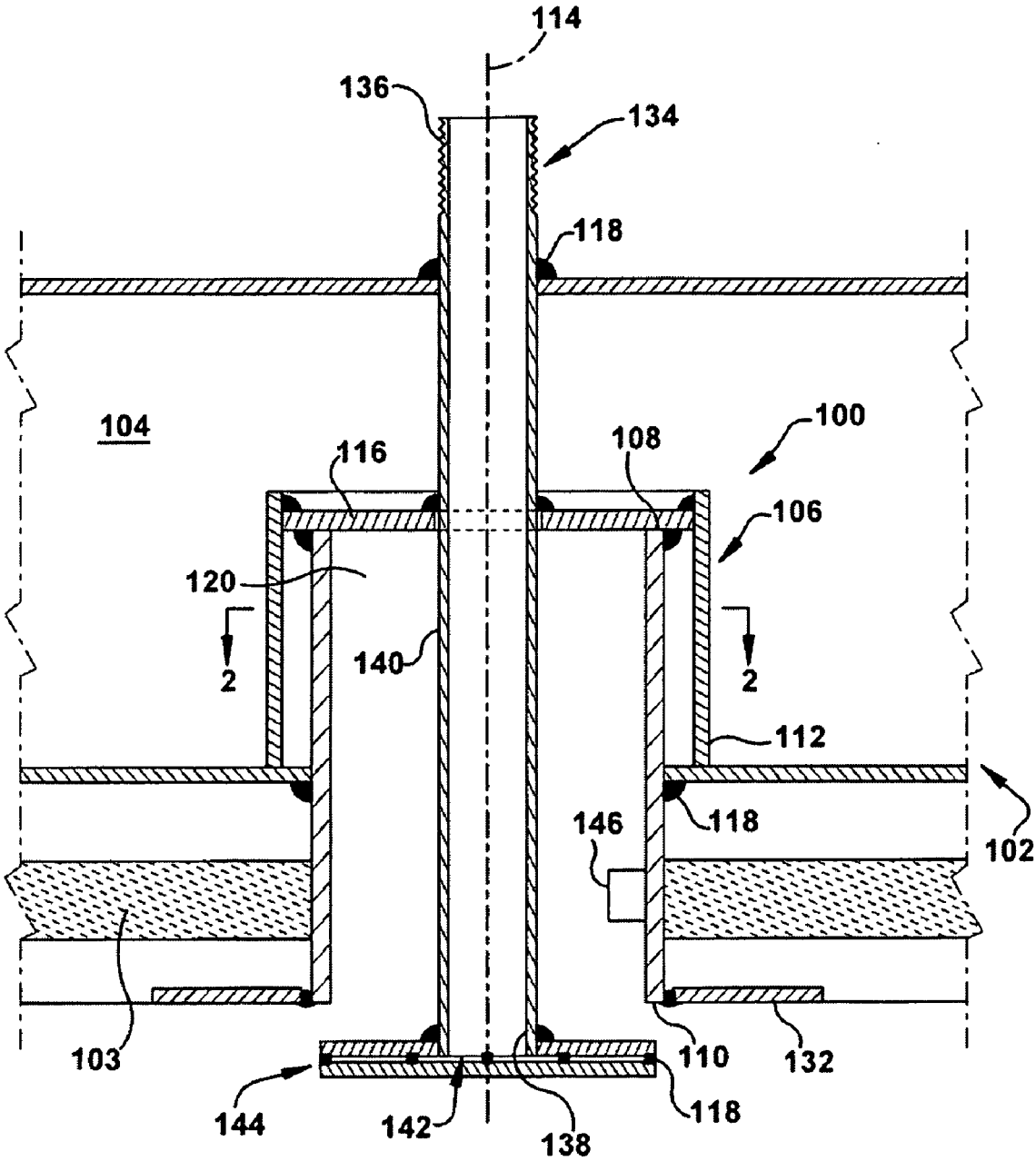
FIG. 1 is a schematic partial side view of an exemplary embodiment of a heating head according to the present invention.

In accordance with the present invention, FIG. 1 depicts an exemplary embodiment of a heating head 100 for use in a paving apparatus (not shown) that is used in paving a road, parking lot, or other paved area. The paving apparatus may be used for repaving or in-place recycling of pavement in a paving application, such as a road or parking lot resurfacing.

The heating head 100, as shown in FIG. 1, is at least partially supported by a heating frame 102 of the paving apparatus. The heating head 100 extends up through the heating frame 102 into an air box 104, to draw in air for combustion. The heating head 100 may also extend through insulation 103, such as ceramic fiber insulation. The heating head 100 may include an ignition source (not shown) to spark the combustion process, or may be ignited by an outside agent. The heat resulting from the combustion of the fuel and the heated air is supplied to the underlying pavement (not shown; located toward the bottom of the page in the orientation of FIG. 1) by the heating head 100.

Figure 2:
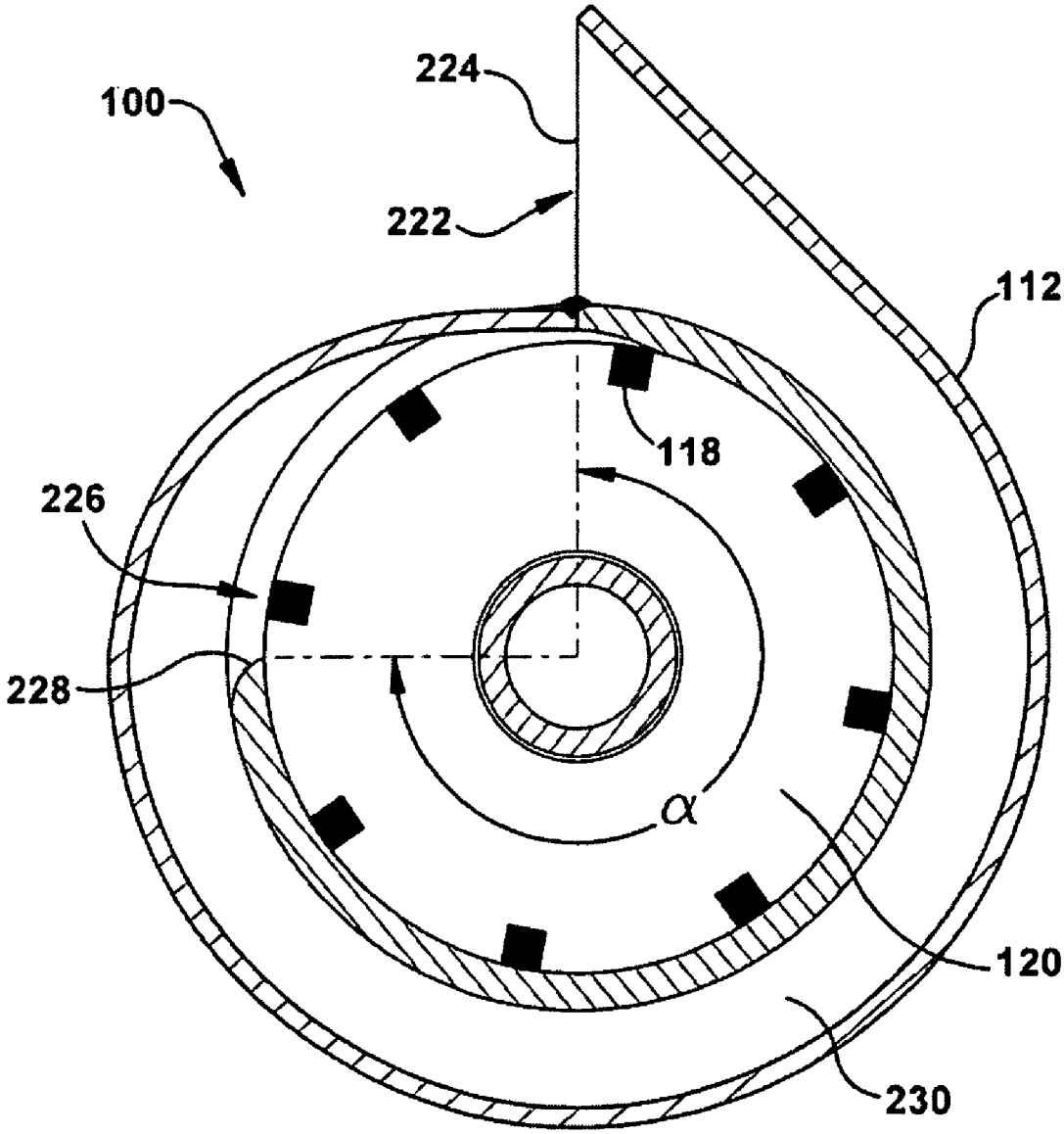
FIG. 2 is a schematic partial cross-section, taken along line 2-2, of the heating head depicted in FIG. 1.

The heating head 100 includes a substantially cylindrical head housing 106, which has a top housing edge 108 axially spaced from a bottom housing edge 110. A sidewall 112 of the head housing 106 has a spiral cross-sectional shape (as shown in FIG. 2, discussed below). The sidewall 112 need not have a homogenous or symmetrical configuration throughout. For example, and with reference to FIG. 1, the sidewall 112 may have a stepped or multi-layer/multi-level cross-sectional shape, depending on the placement of the cross-section along a longitudinal axis 114. A laterally extending top housing cover 116 is attached to at least a portion of the top housing edge 108.

In the Figures, darkened areas at component joints represent welds 118 (most left unlabeled for simplicity) which are used to attach the components to each other at the joint locations. However, any suitable attachment technique or combination thereof may be used in the construction and operation of the present invention, such as, but not limited to, any type of welding, soldering, mechanical adhesion, chemical adhesion, frictional engagement, and separately provided fasteners (e.g., pins, screws, nails, rivets, etc.).

However constructed, the head housing 106 defines an air chamber 120 and is adapted to accept and direct airflow through the heating head 100. The manner in which ambient air may be directed by the head housing 106 through the heating head 100 can be readily understood with reference to the cross-sectional view of FIG. 2. The sidewall 112 defines an intake vent 222 at a radially outward end 224 thereof and an air chamber inlet 226 at a radially inward end 228 thereof.

The intake vent 222 and air chamber inlet 226 are spaced apart and are in mutual fluid communication via an elongated circumferentially extending air passage 230, to form an air intake. More specifically, the radially outward end 224 and radially inward end 228 of the sidewall 112 may be spaced 270 degrees apart, as shown by angle a in FIG. 2, around a circumference of the head housing 106. Though the exact extent of the air passage 230 is dependent upon the configurations of the intake vent 222 and air chamber inlet 226, the air passage may extend substantially three-quarters of the way around the circumference of the heating head 100 as shown in FIG. 2, or may extend any other suitable distance, as desired for a particular application of the present invention. The air passage 230 directs airflow from an exterior of the heating head 100 to the air chamber 120 in a desired manner and may help to impart an enhanced velocity or particular flow orientation to the airflow.

Optionally, the ambient air surrounding the heating head 100 has been preheated from an initial temperature, in any suitable manner. In such manner, the head housing 106 may direct heated airflow through the heating head 100.

A heater flange 132, as shown in FIG. 1, may extend radially outward from the bottom housing edge 110. When present, the heater flange 132 may assist with deflecting heat or flame in a desired manner with respect to the pavement. The heater flange 132 may also or instead help to protect the heating frame 102 from heat damage which might otherwise be caused by the proximity of the heating frame 102 to the heat or flame of the heating head 100.

Once again with reference to FIG. 1, the heating head 100 may include a fuel line 134 having axially spaced top and bottom fuel line ends 136 and 138, respectively, with a fuel line body 140 therebetween. As with the example configuration of FIG. 1, the axial orientation of the fuel line 134 may substantially coincide with the longitudinal axis 114. Additionally, the fuel line 134 may be a substantially straight tubular structure having a homogenous cross-section and being adapted for a screw-type attachment to another structure, as shown. However, the fuel line 134 may have any suitable configuration, dimensions, arrangement, attachment means, or the like, and may be readily provided by one of ordinary skill in the art for a particular application of the present invention.

The fuel line 134 may be connected to the head housing 106, for mechanical support and/or fluidtightness reasons. For example, and as shown in FIG. 1, the fuel line body 140 may extend through, and be optionally connected to, the top housing cover 116. The fuel line 134 may extend longitudinally and substantially symmetrically through the air chamber 120, as shown, or may enter the air chamber at any location and extend into and/or through the air chamber at any angle, and may have any length. Also, the bottom fuel line end 138 may extend longitudinally beyond the bottom housing edge 110, particularly when combustion is intended to take place at an area of the heating head 100 longitudinally below the head housing 106, as described below.

The fuel line 124 is adapted to provide combustion fuel (not shown), such as, but not limited to, propane, to the heating head 100. The fuel line 124 may provide combustion fuel to the heating head 100 via at least one fuel outlet aperture 142 located in any suitable location on the fuel line. For example, if combustion takes place within the air chamber 120, at least one fuel aperture (not shown) could be located in the fuel line body 140.

In the configuration of FIG. 1, at least one fuel outlet aperture 142 is located at the bottom fuel line end 138 because combustion takes place just below the head housing 106. In this arrangement, the air chamber 120 collects, orients, and provides airflow from the air intake structures to an area adjacent the bottom fuel line end 138.

As shown in FIG. 1, a spreader disk 144 (shown here as having a multi-piece construction) may be connected with the bottom fuel line end 138 and be adapted to direct fuel radially outward from the fuel line 134. In this configuration, heat and/or flame also may be directed radially outward from the area of the bottom fuel line end 138 as combustion occurs, to result in desired lateral spreading of the heat provided by the heating head 100.

Optionally, the heating head 100 may include a wired or wireless sensor (shown schematically at 146), which can assist with control and/or observation of the heating process of the heating head 100. The sensor 146 may include at least one of a temperature sensor, an airflow sensor, a combustion sensor, a pressure sensor, or any other suitable type of sensor, whether mechanical, electrical, electronic, piezoelectric, or operative in any other manner. The output signal of the sensor, when present, may be used in the control of the combustion of the heating head 100, as will be discussed below.

Figure 3A:
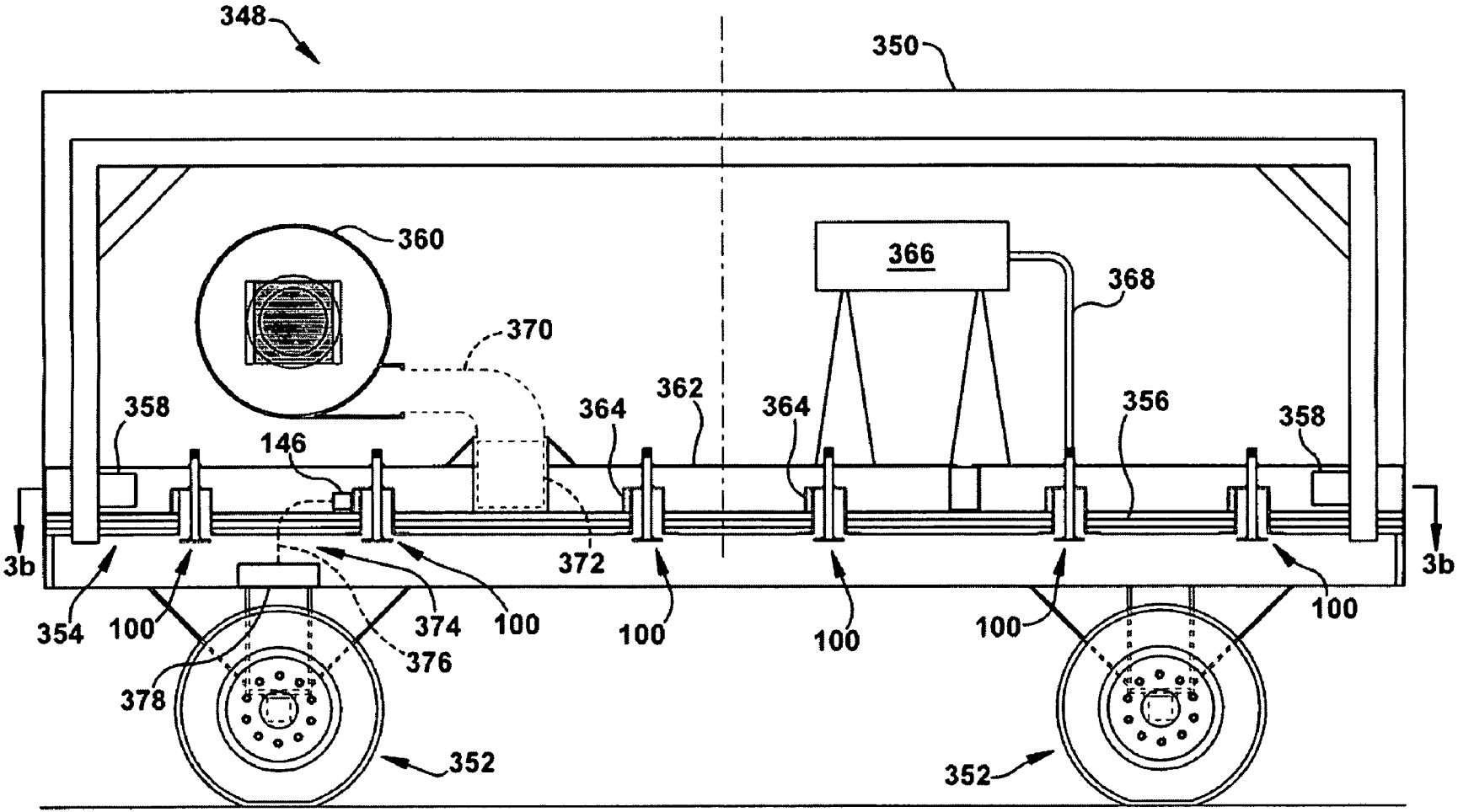
FIG. 3*a* is a schematic partial side view of a furnace device including the heating head depicted in FIG. 1.
Figure 3B:
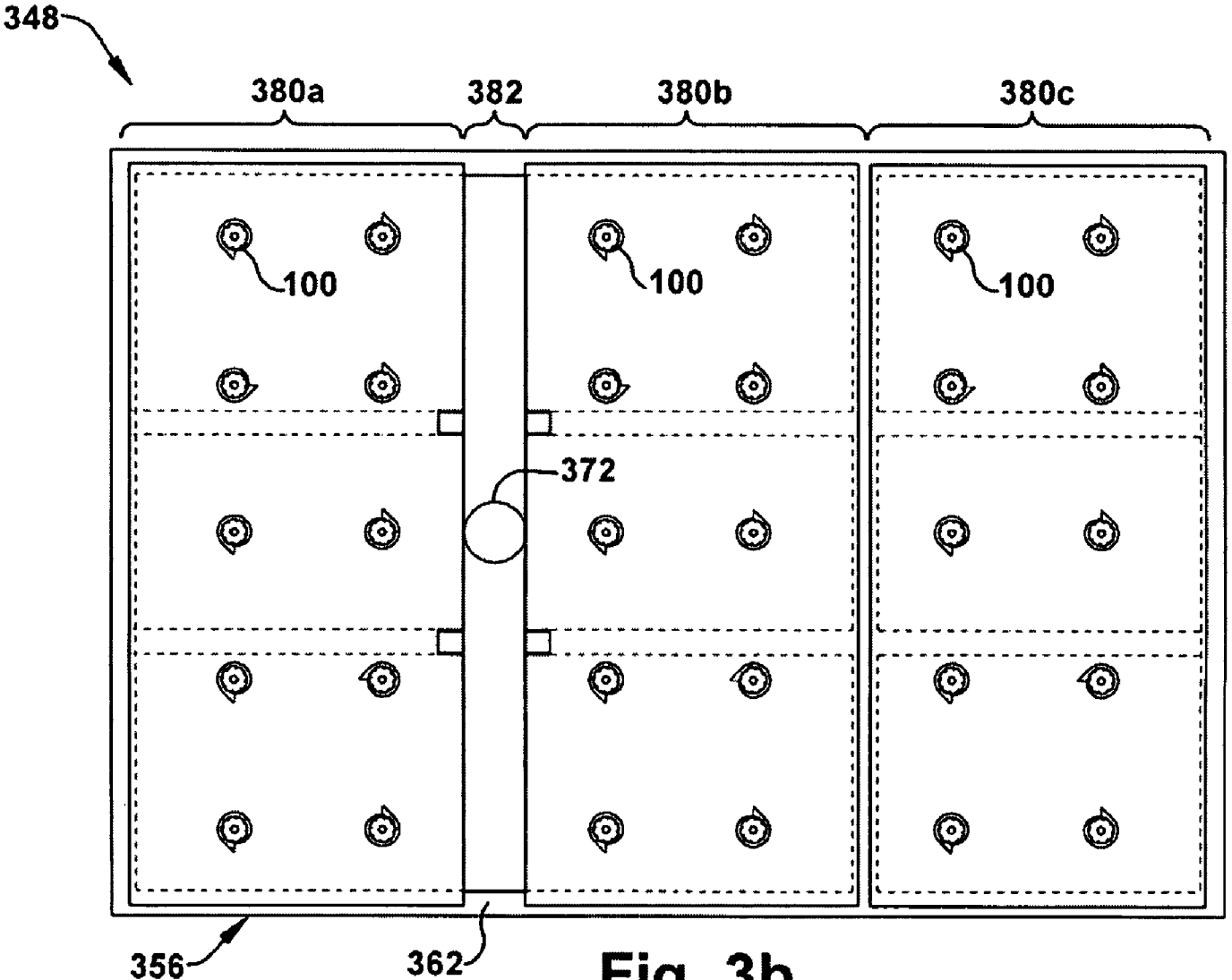
FIG. 3*b* is a schematic partial cross-section, taken along line 3*b*-3*b*, of the furnace device depicted in FIG. 3*a*.

FIGS. 3*a* and 3*b* schematically depict a paving apparatus 348 with which the heating head 100 of the present invention may be used. The paving apparatus 348 shown in these Figures has a furnace body 350 and a suspension system 352 supporting the furnace body 350 and a heating system 354 for movement along a paved area (not shown). Although the furnace body 350 is shown schematically as a line partially surrounding the other described structures, the furnace body may have any suitable shape and may partially or fully enclose one or more other structures of the paving apparatus 348.

The suspension system 352 is adapted to support the furnace body 350 for movement in a longitudinal direction along the paved area. For purposes of this description, the suspension system 352 will be considered to include wheels, tracks, or other movable support structures, as well as the engine, steering, shocks, axles, and the like which are used to power, support, and control the movable support structures.

The paving apparatus 348 is adapted to movably hold a plurality of heating heads 100 a predetermined distance from the pavement of the paved area. The distance between the heating heads 100 and the pavement may be optimized to heat the pavement to a predetermined depth and temperature during a paving and/or pavement recycling operation.

The heating system 354 includes a heating frame 356, which is carried by the suspension system 352 and is adapted to movably hold the plurality of heating heads 100 a predetermined distance from the paved area traversed by the paving apparatus 348. The distance between the heating heads 100 and the pavement may be changed as desired during operation of the paving apparatus 348 by adjusting the heating frame 356, upon which the heating heads are carried, using a height adjustment mechanism 358. The height adjustment mechanism 358 of the heating frame 356 may be of any suitable type, such as a piston cylinder arrangement, a rack-and-pinion system, a cotter pin and suspension arm arrangement, or the like, and may be readily provided by one of ordinary skill in the art.

The heating system 354 also includes a fan 360 which is located within the furnace body 350 and is adapted to circulate air through the furnace body. An air box 362 is associated with the heating frame 356, and optionally with the fan 360, and is adapted to absorb heat from the heating frame and disperse the heat to airflow within the furnace body 350 and to airflow directed to an air intake of at least one heating head 100. Each heating head 100 has an air intake, designated generally as 364 (for clarity, most left unlabeled in FIGS. 3*a* and 3*b*) and including the intake vent 222, air chamber inlet 226, and air passage 230.

The fuel line body 140 of at least one of the heating heads 100 may extend through, and be connected to, both the air box 362 and, as previously mentioned, the top housing cover 116. A fuel tank 366 may be carried by the suspension system 352. As shown, the fuel tank 366 may be located inside the furnace body 350. However, and perhaps related to the elevated temperatures which occur inside the furnace body 350 due to operation of the heating heads 100, the fuel tank 366 may instead be placed outside the furnace body 350 yet still on the paving apparatus 348, or may even be external to the paving apparatus 348, such as by location on a towed trailer (not shown).

At least one fuel master line 368 may be provided, with only one shown for clarity in FIG. 3*a*. When present, the fuel master line 368 is adapted to supply fuel, such as the previously mentioned propane, from the fuel tank 366 to the fuel line 134 of at least one heating head 100. Optionally, the fuel master line 368 may be integrally formed with at least one fuel line 134.

It is contemplated that the air box 362 may be in fluid communication to accept air from the furnace body 350 in several different ways. The top of the air box 362 may be fully open to the furnace body 350. One or more air box inlets (not shown) could accept air under ambient pressure from various locations in the furnace body 350 or from an atmosphere surrounding the paving apparatus 348. Optionally, as shown schematically by the dashed line in FIG. 3*a*, an air duct 370 may route airflow directly from the fan 360 to an air box inlet 372. The latter arrangement may be capable of providing heated air from within the furnace body 350 to the air box 362 under pressure, thus forcing airflow through the air intake 364 structures of at least one heating head 100 at a higher rate than natural airflow convection within the air box 362 would normally provide, which may be desirable in certain combustion schemes.

It is also contemplated that a control system (shown generally at 374) may be provided, with the control system being adapted to regulate the combustion process of at least one heating head 100. The control system 374, when present, may regulate the combustion process through controlling pressure, volume, or any other characteristic of the fuel and/or airflow provided to the heating head 100, or by changing the position of an adjustable structure, such as a fuel nozzle (not shown), of the heating head. Regardless of the mechanism by which regulation of at least one heating head 100 is provided, the control system 374 may manually or automatically control the regulation responsive to a signal from a sensor 146, such as those described above. The signal may be passed wired or wirelessly over a control link (shown schematically at 376 by a dashed line) to a central controller 378, which may be of any suitable electrical, electronic, mechanical, electromechanical, or other type. A user may interact with the central controller 374 to regulate the combustion process of at least one heating head 100.

An exemplary arrangement of the plurality of heating heads 100 is shown in the grid-type layout seen in the cross-sectional view of FIG. 3*b*. The plurality of heating heads 100 may define a plurality of separably controllable heating zones 380*a*, 380*b*, and 380*c*, which are arranged in sequence within the paving apparatus 348. An operator of the paving apparatus 348 may control the heat output by each heating zone 380 based upon the temperature of the pavement beneath that heating zone 380. Although three heating zones 380*a*, 380*b*, and 380*c* are shown, any desired number of heating zones may be provided.

An experienced operator may be able to determine whether the pavement has reached the desired predetermined temperature based upon the appearance of the pavement, a sensed temperature at a certain distance from the pavement, or another observable factor combined with the operator's experience and training. The operator may then manually or automatically control each heating zone 380 individually to bring the pavement to the predetermined temperature without overheating and scorching the topmost surface of the pavement. For example, a first plurality of heating heads 100 associated with the heating frame 356 may be mutually controlled to provide the first heating zone 380*a*, while a second plurality of heating heads 100 may be mutually controlled to provide a second heating zone 380*b* which is independently controlled from the first heating zone 380*a*.

The sequential arrangement of heating zones 380*a*, 380*b*, and 380*c* allows for ongoing temperature observation and adjustment as the pavement is heated. Therefore, the operator has greater control of the temperature of the entire pavement with the use of heating zones 380 than if the pavement were merely subjected to one pass of a fixed-temperature array of heating heads 100.

Optionally, and as shown at 382 in FIG. 3*b*, any of the heating zones 380*a*, 380*b*, or 380*c* may be spaced any suitable distance apart on the heating frame 356 from an adjacent heating zone 380*a*, 380*b*, or 380*c*. The spacing 382 may be an artifact of the placement of other structures of the paving apparatus 348 (such as the air box inlet 372 in FIG. 3*b*) or may be intentionally provided to allow an already heated section of pavement to rest or soak for a period of time without application of heat while maintaining a travel speed of the paving apparatus 348 along the pavement. For example, a soaking zone could have a width configured to provide a predetermined amount of soaking time when the paving apparatus 348 is traveling at a predetermined speed along the pavement. This soaking time may allow the applied heat to penetrate from the very top surface of the pavement into the depth of the pavement toward the substrate (not shown). The soaking period may prevent scorching or burning of the top of the pavement while still achieving a suitable temperature rise through the depth of the pavement to provide desired resurfacing properties. By providing the spacing 382, when present, the paving apparatus 348 can travel at a near-constant speed (for ease of control by a driver) while still providing a soaking period, when desired.

The heating zones 380*a*, 380*b*, and 380*c* may each be associated with at least one zone sensor (not shown). The zone sensor may be adapted to control at least one heating head 100, via interaction with the control system 374 to heat the pavement to the predetermined temperature instead of or in addition to an operator who manually judges the heat of the pavement beneath each heating zone 380.

Figure 4:
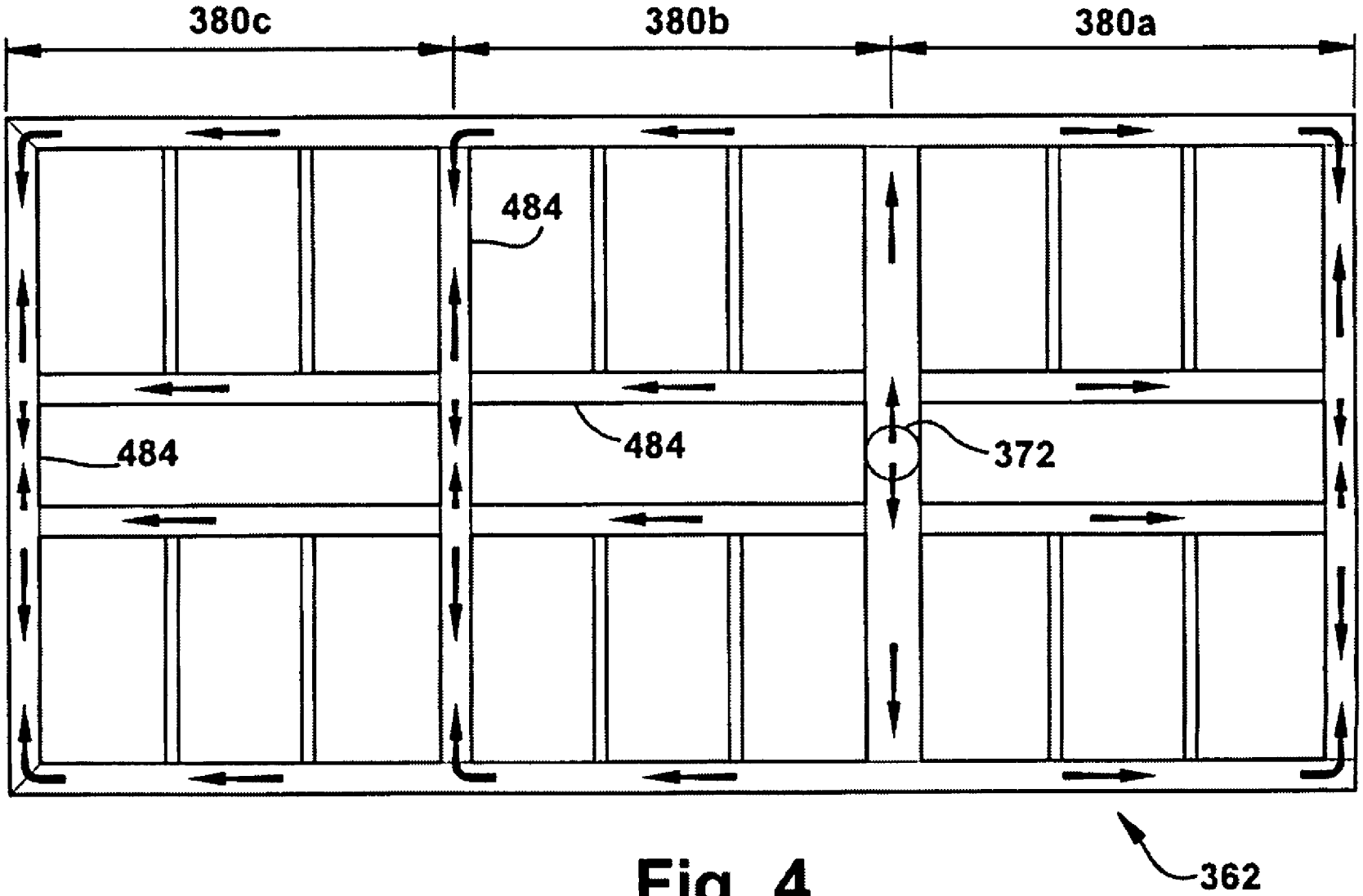
FIG. 4 is a schematic partial plan view of the furnace device depicted in FIG. 3*a*.

The heating system 354 provides the ambient air from within the furnace body 350 to the heating heads 100 through use of the previously mentioned air box 362. As depicted in plan view in FIG. 4, the air box 362 is a ductwork structure adjacent the heating frame 356 and connected to the fan 360 by the air duct 370. One possible airflow routing is shown by the arrows in FIG. 4. Air is passed to the air box 362 from the air duct 370 via the air box inlet 372. Once in the air box 362, the airflow circulates to the heating heads 100, optionally under pressure from the fan 360. The airflow may roam freely within a relatively open air box 362 structure or may be directed to one or more heating heads 100 through at least one circulation duct 484 (several left unlabeled for clarity), such as the sample grid arrangement of a plurality of circulation ducts shown in FIG. 4.

In order to use the paving apparatus 348 to heat a paved area, the suspension system 352 is controlled to place the paving apparatus 348 in a desired orientation with the selected paved area. At least one heating head 100 is provided with fuel and is ignited manually or automatically. The ignited heating head(s) 100 will generate and direct heat toward the paved area as long as an adequate fuel supply is maintained. The suspension system 352 is then actuated to pass the paving apparatus 348 over the paved area at a suitable speed to allow the heating head(s) 100 to heat the paved area as desired. The control system 374, when present, may be used to help fine-tune the heating of the paved area. Additionally or alternatively, the operator may manually control the paving apparatus 348 travel speed, heating head 100 operation, or any other characteristic to heat the paved area as desired. When provided, multiple heating zones 380 may be employed, optionally with spacing 382 therebetween to allow heat penetration, to assist with heating the paved area. The operator may control the paving apparatus 348 to make multiple passes over the same paved area, in any travel direction (s), as desired, until the paved area has reached the desired temperature.

While aspects of the present invention have been particularly shown and described with reference to the preferred embodiment above, it will be understood by those of ordinary skill in the art that various additional embodiments may be contemplated without departing from the spirit and scope of the present invention. For example, the head housing 106, and any other portions or structures of the heating head 100, may be integrally formed or constructed in any suitable manner of separate pieces. Any structures of the present invention may be formed integrally or separately assembled in any manner, of any suitable material or combination of materials. However, a device or method incorporating such an embodiment should be understood to fall under the scope of the present invention as determined based upon the claims below and any equivalents thereof.

Other aspects, objects, and advantages of the present invention can be obtained from a study of the drawings, the disclosure, and the appended claims.

Having described the invention, the following is claimed:

1. A heating head for a paving apparatus, the heating head comprising:

a substantially cylindrical head housing, having a top housing edge axially spaced from a bottom housing edge, a sidewall having a spiral cross-sectional shape and a laterally extending top housing cover attached to at least a portion of the top housing edge, the head housing defining an air chamber and being adapted to accept and direct airflow through the heating head;

wherein the sidewall defines an intake vent at a radially outward end and an air chamber inlet at a radially inward end, the intake vent and air chamber inlet being spaced apart and in mutual fluid communication via an elongated circumferentially extending air passage to direct airflow from an exterior of the heating head to the air chamber.

2. The heating head of claim 1, wherein the head housing directs heated airflow through the heating head.

3. The heating head of claim 1, further comprising at least one of a temperature sensor, an airflow sensor, a combustion sensor, and a pressure sensor.

4. The heating head of claim 1, further comprising a heater flange extending radially outward from the bottom housing edge.

5. The heating head of claim 1, wherein the radially outward end and radially inward end of the sidewall are spaced 270 degrees apart along the sidewall around a circumference of the head housing.

6. The heating head of claim 1, further comprising a fuel line having axially spaced top and bottom fuel line ends with a fuel line body therebetween, the fuel line being connected to the head housing and extending longitudinally through the air chamber, the fuel line being adapted to provide combustion fuel to the heating head.

7. The heating head of claim 6, wherein the fuel line body extends through, and is connected to, the top housing cover.

8. The heating head of claim 6, wherein the bottom fuel line end extends longitudinally beyond the bottom housing edge.

9. The heating head of claim 8, further comprising a spreader disk connected with the bottom fuel line end and adapted to direct fuel radially outward from the fuel line.

10. The heating head of claim 6, wherein the fuel line is adapted to supply propane to the heating head.

11. A heating system for a paving apparatus having a furnace body and a suspension system supporting the furnace body and heating system for movement along a paved area, the heating system comprising:

a heating frame carried by the suspension system and adapted to movably hold a plurality of heating heads a predetermined distance from the paved area;

a fan located within the furnace body and adapted to circulate air through the furnace body; and an air box associated with the heating frame and adapted to absorb heat from the heating frame and disperse the heat to airflow within the furnace body and to airflow directed to an air intake of at least one heating head;

wherein the air intake of the heating head includes an elongated circumferentially extending air passage wrapping around at least a portion of the heating head, the air passage having an intake vent at a radially outward end and an air chamber inlet at a radially inward end, the intake vent and air chamber inlet being spaced apart and in mutual fluid communication via the air passage to direct airflow from an exterior of the heating head to an air chamber within the heating head.

12. The heating system of claim 11, wherein the circumferentially extending air passage wraps laterally around at least three-quarters of a circumference of the heating head.

13. The heating system of claim 11, wherein the heating head includes:

a substantially cylindrical head housing, having a top housing edge axially spaced from a bottom housing edge, a sidewall having a spiral cross-sectional shape and extending between the top and bottom housing edges to define the air chamber, and a laterally extending top housing cover attached to at least a portion of the top housing edge, the head housing being adapted to accept and direct airflow from the air box through the heating head;

wherein the sidewall defines the intake vent at a radially outward end thereof and the air chamber inlet at a radially inward end thereof.

14. The heating system of claim 13, further comprising a fuel line having axially spaced top and bottom fuel line ends with a fuel line body therebetween, the fuel line being connected to the head housing and extending longitudinally through the air chamber, the fuel line being adapted to provide combustion fuel to the heating head.

15. The heating system of claim 14, wherein the fuel line body extends through, and is connected to, the air box and the top housing cover.

16. The heating system of claim 11, further comprising a fuel tank carried by the suspension system and at least one fuel master line adapted to supply combustion fuel to at least one heating head.

17. The heating system of claim 11, further comprising at least one of a temperature sensor, an airflow sensor, a combustion sensor, and a pressure sensor.

18. The heating system of claim 11, further comprising a control system adapted to regulate the combustion process of at least one heating head.

19. The heating system of claim 18, wherein the control system regulates the combustion process of at least one heating head responsive to a signal from at least one of a temperature sensor, an airflow sensor, a combustion sensor, and a pressure sensor.

20. The heating system of claim 11, wherein a first plurality of heating heads associated with the heating frame are mutually controlled to provide a first heating zone, and a second plurality of heating heads associated with the heating frame are mutually controlled to provide a second heating zone which is independently controlled from the first heating zone.

21. The heating system of claim 20, wherein the first and second heating zones are spaced apart on the heating frame.

22. The heating system of claim 11, wherein the air box disperses the heat to airflow directed to an air intake of at least one heating head from at least one air box inlet and through at least one circulation duct.

* * * * *